US008047373B2

(12) United States Patent
Murphy

(10) Patent No.: US 8,047,373 B2
(45) Date of Patent: Nov. 1, 2011

(54) SUSPENDED UTENSIL STORAGE SYSTEM AND METHOD

(76) Inventor: Michael P. Murphy, Goleta, CA (US)

( * ) Notice: Subject to any disclaimer, the term of this patent is extended or adjusted under 35 U.S.C. 154(b) by 0 days.

(21) Appl. No.: 12/772,876

(22) Filed: May 3, 2010

(65) Prior Publication Data

US 2010/0282635 A1 Nov. 11, 2010

Related U.S. Application Data

(60) Provisional application No. 61/177,185, filed on May 11, 2009.

(51) Int. Cl.
*B65D 21/00* (2006.01)

(52) U.S. Cl. ..... 206/553; 206/519; 206/514; 220/23.4

(58) Field of Classification Search ..... 220/486; 206/561, 518, 519, 515, 507, 514, 553
See application file for complete search history.

(56) References Cited

U.S. PATENT DOCUMENTS

| | | | | |
|---|---|---|---|---|
| 4,053,280 | A * | 10/1977 | Salisbury | 206/363 |
| 4,351,448 | A * | 9/1982 | Ingersoll et al. | 220/318 |
| 5,044,059 | A | 9/1991 | De Giulio | |
| 5,184,749 | A * | 2/1993 | Attenasio | 220/572 |
| 5,220,886 | A | 6/1993 | Hyde | |
| 5,468,062 | A | 11/1995 | Finnegan | |
| 5,984,440 | A | 11/1999 | Watson | |
| 6,161,718 | A * | 12/2000 | Monbo | 220/486 |
| 6,581,771 | B2 * | 6/2003 | McDade | 206/505 |
| D479,272 | S * | 9/2003 | Hardy et al. | D19/92 |
| 6,769,538 | B2 | 8/2004 | Oswald | |
| 7,044,292 | B2 * | 5/2006 | Nall | 206/216 |
| 7,325,774 | B2 * | 2/2008 | Jun et al. | 245/2 |
| 7,380,894 | B2 | 6/2008 | Berger | |
| 7,784,615 | B2 * | 8/2010 | Stahl | 206/511 |
| 2003/0047084 | A1 | 3/2003 | Shandross | |
| 2007/0102385 | A1 | 5/2007 | Killinger | |
| 2007/0262038 | A1 | 11/2007 | Harbison | |
| 2008/0083628 | A1 | 4/2008 | Sines | |
| 2008/0202976 | A1 * | 8/2008 | Burgess et al. | 206/558 |

FOREIGN PATENT DOCUMENTS

| | | |
|---|---|---|
| JP | 2001-299673 | 10/2001 |
| JP | 2003-246376 | 9/2003 |

OTHER PUBLICATIONS

International Search Report and Written Opinion dated Oct. 8, 2010 for PCT/US10/33602.

* cited by examiner

*Primary Examiner* — J. Gregory Pickett
*Assistant Examiner* — Raven Collins
(74) *Attorney, Agent, or Firm* — Stephen C. Beuerle; Procopio Cory Hargreaves & Savitch LLP

(57) ABSTRACT

A suspended utensil storage system includes a utensil tray including a plurality of utensil compartments having a mesh material therein; and a debris collector tray underlying the utensil tray and receiving the utensil tray. The mesh material of the utensil compartments of the utensil tray supports utensils and includes holes sized to allow debris to fall there through into the debris collector tray for collecting the debris.

20 Claims, 8 Drawing Sheets

SUSPENDED UTENSIL STORAGE SYSTEM AND METHOD

FIELD OF THE INVENTION

The field of the invention relates to kitchen utensil storage systems.

BACKGROUND OF THE INVENTION

Standard utensil storage trays that sit in kitchen drawers collect kitchen food particles and other debris within the very compartments intended to store cleaned eating utensils allowing for potentially soiling and infecting the eating tools. Cleaning these standard trays involves removing all of the many utensils and scrubbing the many corners and curves where particles and scum may accumulate.

SUMMARY OF THE INVENTION

To overcome the above problems and others, an aspect of the invention involves a suspended utensil storage system that maintains debris separated from utensils while allowing for easy occasional clean up of a debris collector without having to remove dozens of separate flatware and other kitchen tools.

A two-piece storage system includes a utensil tray made of sturdy wide mesh material that nests suspended in a debris collector tray allowing counter crumbs and other kitchen debris to pass through the utensil compartments to the debris collector tray below. This suspension system prevents clean utensils from being soiled from food particles and other kitchen debris as well as assists in preventing potential health risks from utensils coming in consistent contact with unsanitary food particles and other debris.

Wide grid plastic or metal material forms utensil tray, allowing support of utensils while gravity pulls crumbs, dust, and other debris through open spaces to debris collector carrier below in which the utensil tray is nested.

Sturdy formed utensil tray lifts easily out with utensils remaining in the upper mesh tray thereby allowing for easy exposure, extraction, and cleaning of the debris collector.

Sturdy solid debris collector tray is easily separated from the porous utensil tray for hand or dishwashing machine-safe cleansing.

In one or more embodiments, the mesh carrier/utensil tray nests in the lower crumb collector/debris collector tray, is supported by a "ledge" in the upper and/or lower parts of the debris collector tray, and/or the utensil tray includes a "lip" that fits on the debris collector tray like a well-fitted pot cover.

Fewer edges and angles in the collector are preferred to make fewer surfaces for easier cleaning.

The utensil tray needs to support the weight of the utensils and not bend or lose form over time.

Another aspect of the invention involves a suspended utensil storage system including a utensil tray having a plurality of utensil compartments having a mesh material therein; and a debris collector tray underlying the utensil tray and receiving the utensil tray. The mesh material of the utensil compartments of the utensil tray supports utensils and includes holes sized to allow debris to fall there through into the debris collector tray for collecting the debris.

Further objects and advantages will be apparent to those skilled in the art after a review of the drawings and the detailed description of the preferred embodiments set forth below.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION OF PREFERRED EMBODIMENT OF THE INVENTION

Figure 1:
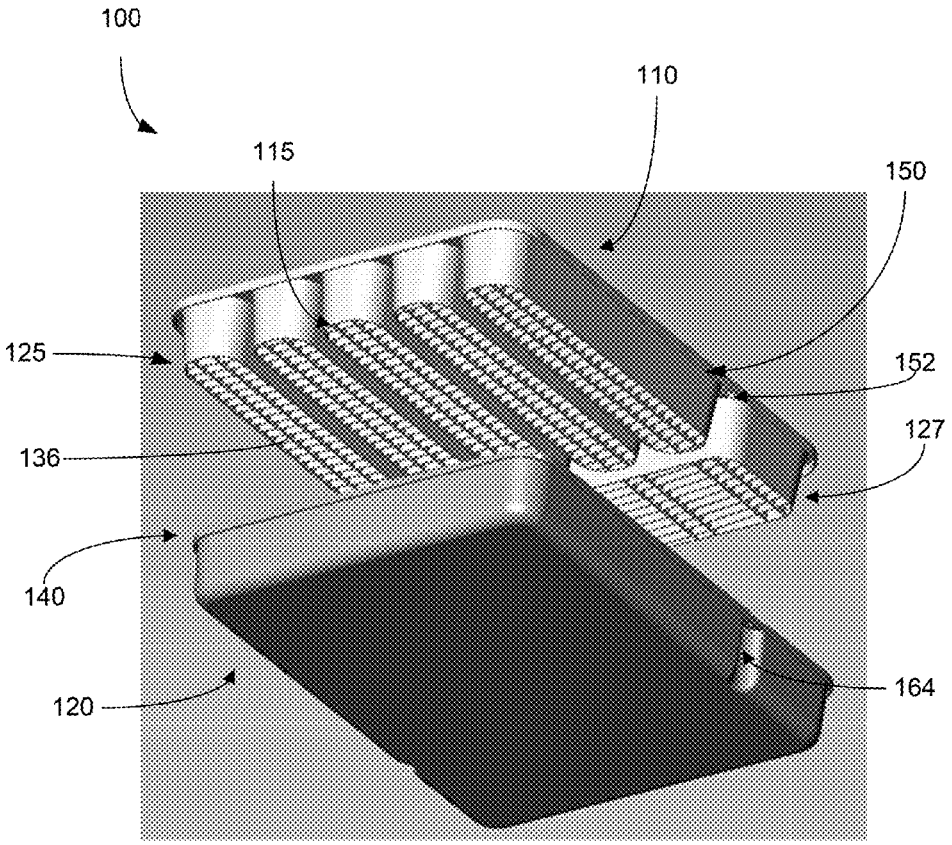
FIG. 1 is a bottom perspective view of an embodiment of a suspended utensil storage system.
Figure 2:
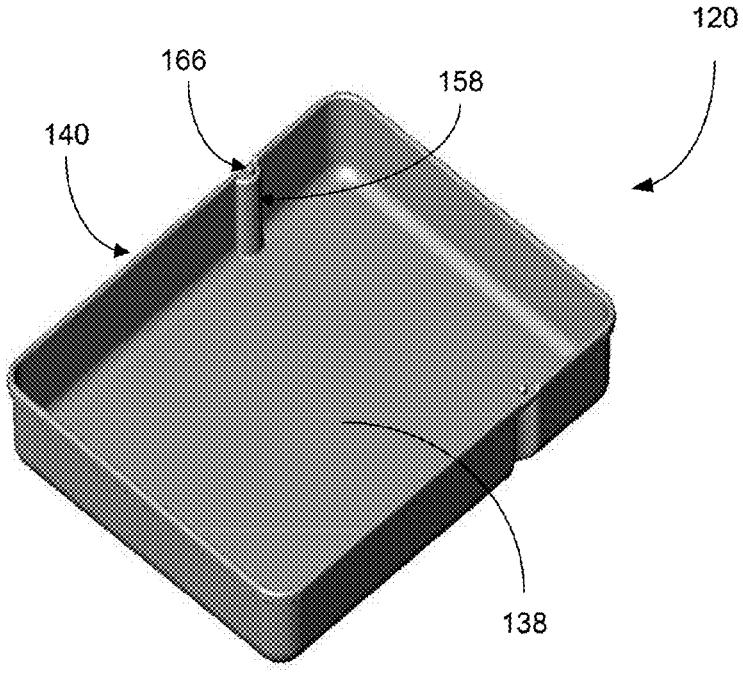
FIG. 2 is a top perspective view of an embodiment of a debris collector tray of the suspended utensil storage system.
Figure 3:
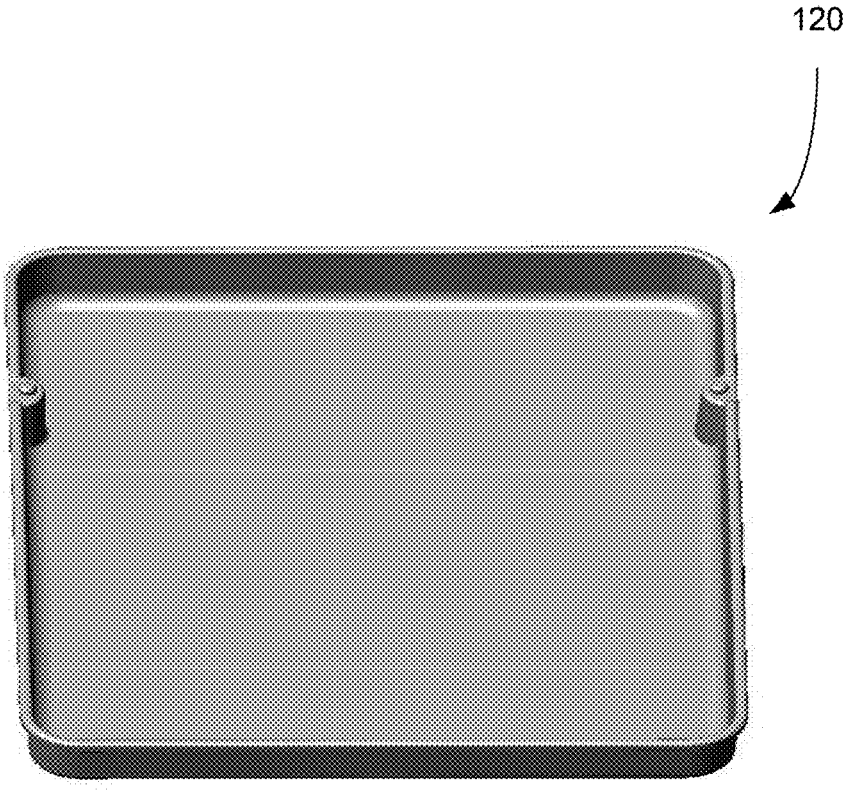
FIG. 3 is another top perspective view of the debris collector tray of the suspended utensil storage system.
Figure 4:
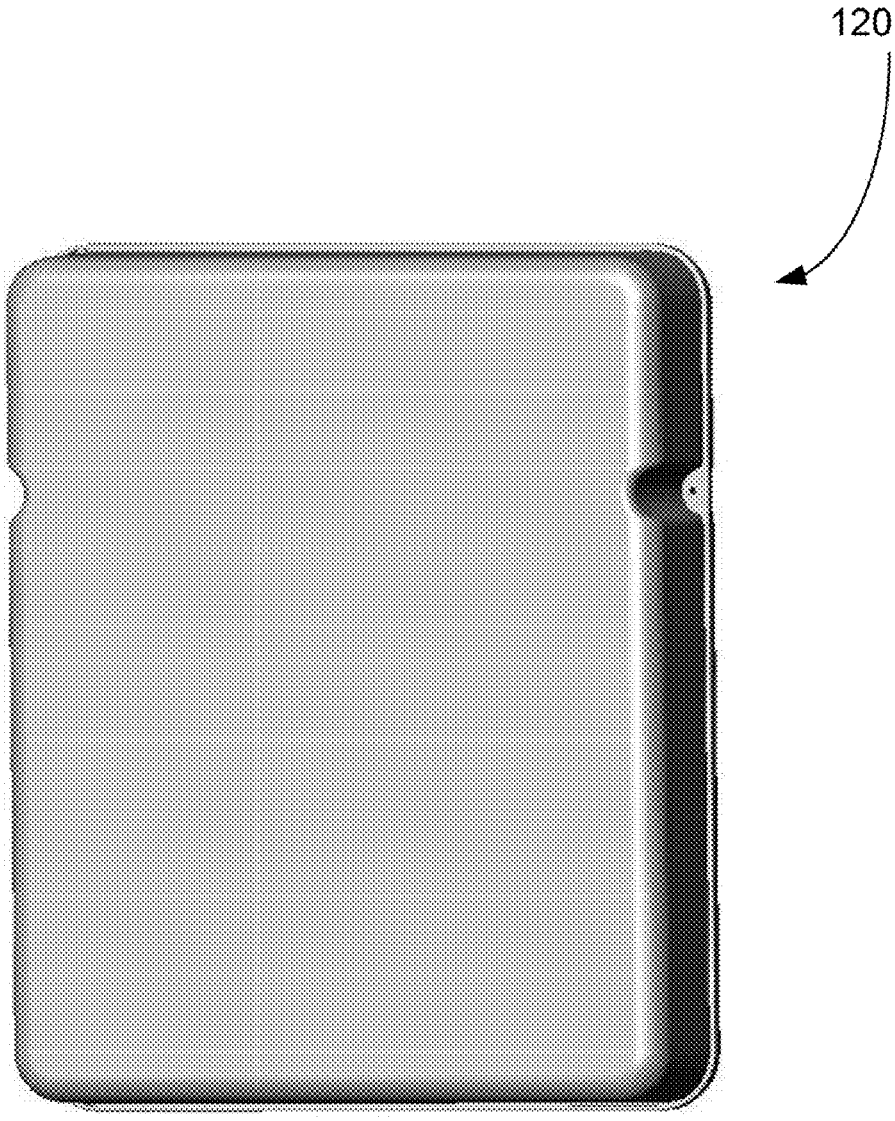
FIG. 4 is a further top perspective view of the debris collector tray of the suspended utensil storage system.
Figure 5:
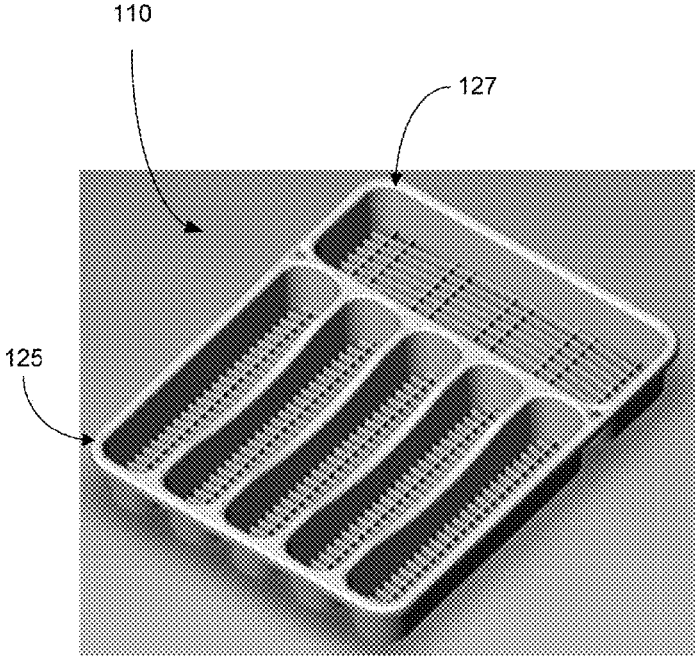
FIG. 5 is a top perspective view of an embodiment of a utensil tray of the suspended utensil storage system.
Figure 6:
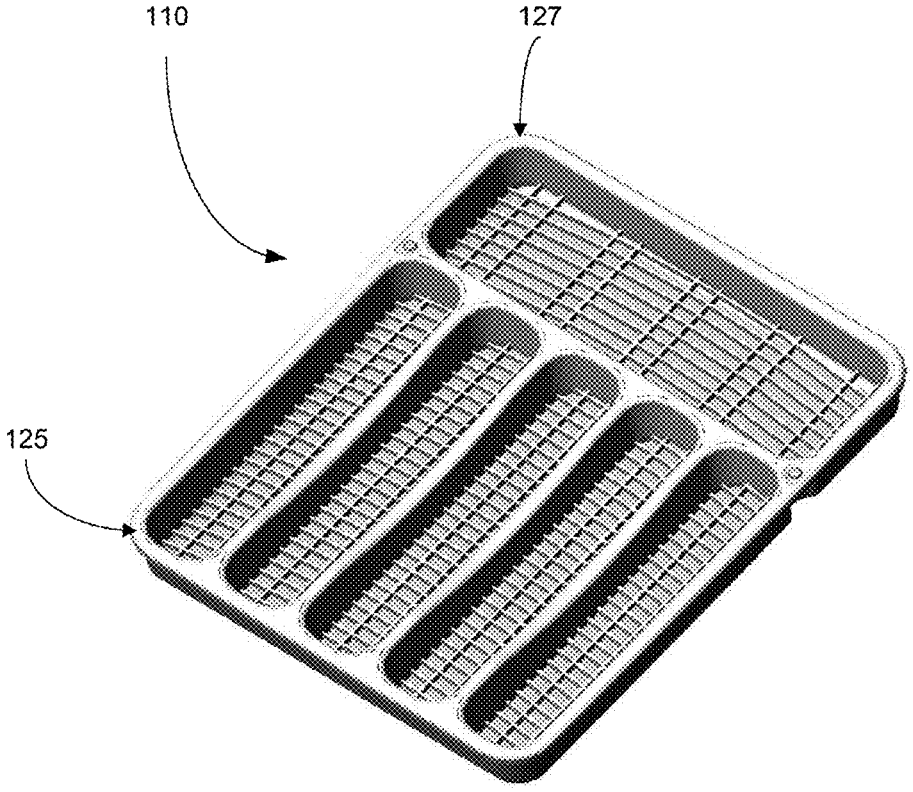
FIG. 6 is another top perspective view of the utensil tray of the suspended utensil storage system.

With reference to FIGS. 1-4, embodiment(s) of a suspended utensil storage system ("suspension system") 100 that maintains debris separated from utensils while allowing for easy occasional clean up of a debris collector without having to remove dozens of separate flatware and other kitchen tools will be described.

The suspension system 100 is a two-piece storage system including a utensil tray 110 made of sturdy wide mesh material 115 that nests suspended in a debris collector tray 120 allowing counter crumbs and other kitchen debris to pass through utensil compartments 125, 127 to the debris collector tray 120 below. This suspension system 100 prevents clean utensils from being soiled from food particles and other kitchen debris as well as assists in preventing potential health risks from utensils coming in consistent contact with unsanitary food particles and other debris.

The suspension system 100, the utensil tray 110, and the debris collector tray 120 all have substantially the same overall length, width, and height. Further, during normal use, the utensil tray 110 is disposed substantially completely within the debris collector tray 120.

Figure 7:
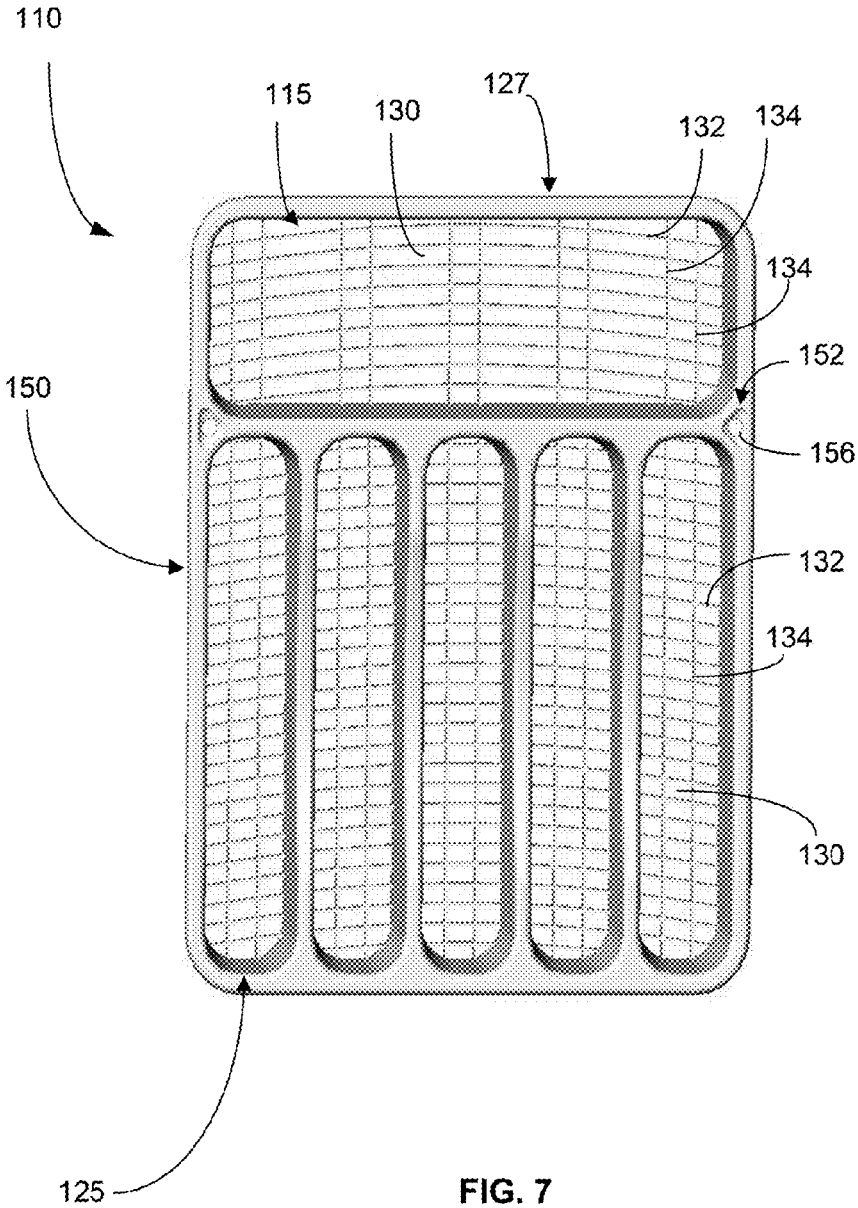
FIG. 7 is a top plan view of the utensil tray of the suspended utensil storage system.
Figure 8:
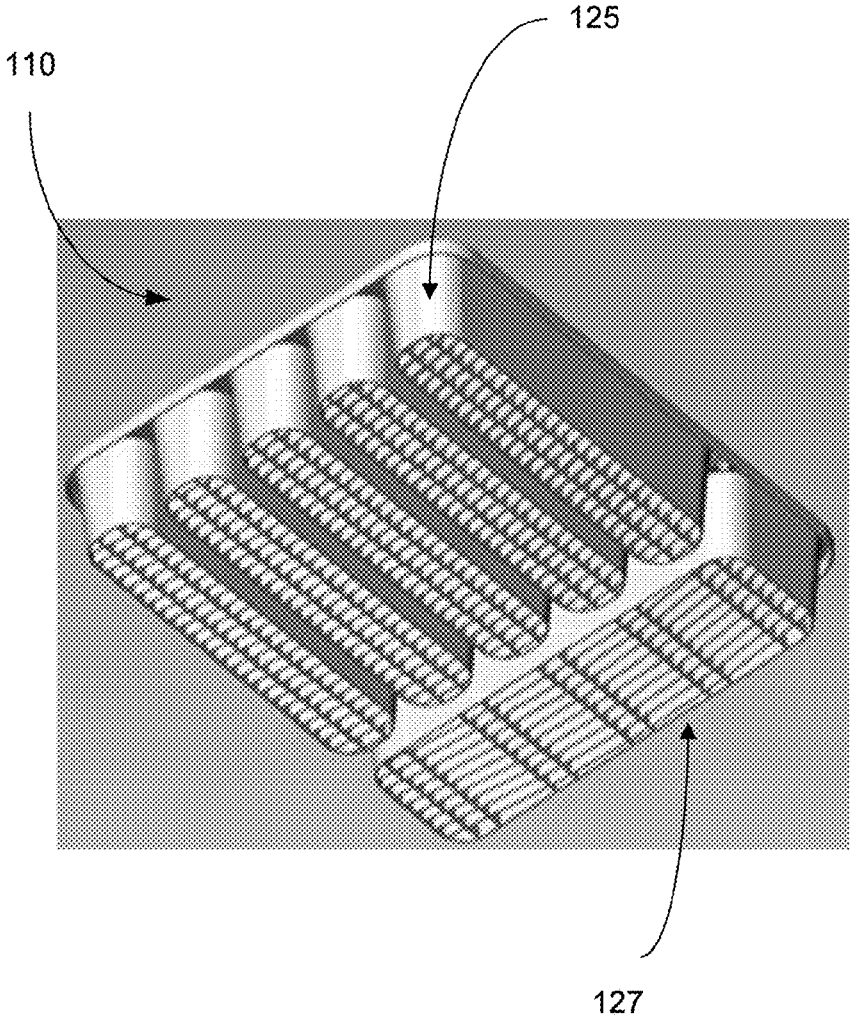
FIG. 8 is a bottom perspective view of the utensil tray of the suspended utensil storage system.

As shown in FIG. 7, wide grid plastic or metal material forms utensil tray 110 allowing support of utensils while gravity pulls crumbs, dust and other debris through open spaces/holes 130 to debris collector tray 120 below in which the utensil tray 110 is nested. Each open space/hole 130 is defined by lateral support rib 132 and longitudinal support rib 134 and has a width, a length, and height. In one embodiment, for each open space, where the width and the length are not the same, the smallest of the width and the height (i.e., smallest dimension in the plane of the mesh material 115) has a distance/dimension of at least 0.05 inches. In another embodiment, for each open space, where the width and the length are not the same, the greater of the width and the height (i.e., maximum dimension in the plane of the mesh material 115) has a distance/dimension of 1 inch). In further embodiment, the area of each open space/hole 130 (in the plane of the mesh material 115) is at least 0.0025 in.$^2$ In a still further embodiment, the area of each open space/hole 130 (in the plane of the mesh material 115) is no greater than 1 in.$^2$ The sizing of the open spaces/holes 130 and thickness/dimensions of the mesh material 115 is designed to support the weight of the utensils so that the mesh material 115 does not bend or lose form over time while allowing crumbs and other debris to pass through the open spaces/holes 130. In alternative embodiments, the open spaces/holes 130 may have dimensions and/or areas other than those indicated above and herein.

The utensil compartments include a bottom surface 136 (FIG. 1) and the debris collector tray includes a floor 138, and the distance between the bottom surface 136 of the utensil compartments and the floor 138 is at least 0.05 in.

Sturdy formed utensil tray 110 lifts easily out with utensils remaining in the utensil tray 110 thereby allowing for easy exposure, extraction and cleaning of the debris collector tray 120.

Sturdy solid debris collector tray 120 is easily separated from the porous utensil tray 110 for hand or dishwashing machine-safe cleansing.

In one or more embodiments, the utensil tray 110 nests in the debris collector tray 120, is supported by a ledge 140 of the debris collector tray 120, and/or the utensil tray 110 includes a lip 150 that fits on the debris collector tray 120 like a well fitted pot cover.

In the embodiment shown, the utensil tray 110 includes outer peripheral lip 150 that surrounds the utensil compartments 125. The lip 150 includes recessed hole-receiving portions 152 along opposite sides 154 of the utensil tray 110, where left and right outermost longitudinally oriented utensil compartments 125 join with laterally oriented large utensil compartment 127. The recessed hole-receiving portions 152 include receiving holes 156.

The debris collector tray 120 includes half-cylindrical members 158 that extend laterally inward from side walls 162 (creating outer incurved recesses 164). Alignment posts/nubs 166 protrude upwardly from a top of the half-cylindrical members 158.

When the utensil tray 110 is lowered onto and nested into the debris collector tray 120, the peripheral lip 150 of the utensil tray 110 rests on peripheral ledge 140 of the debris collector tray 120 and the pair of receiving holes 156 of the recessed hole-receiving portions 152 receive the alignment posts/nubs 166 of the half-cylindrical members 158. With the alignment posts/nubs 166 disposed in the recessed hole-receiving portions 152, the utensil tray 110 is secured relative to the debris collector tray 120 so that the only relative movement allowed is upward relative movement so that the utensil tray 110 and the debris collector tray 120 do not move relative to each other than upward movement of the utensil tray 110 for removing the nested utensil tray 110 from the debris collector tray 120 (e.g., during cleaning, dishwashing).

The debris collector tray 120 includes very few edges and angles to make fewer surfaces for easier cleaning.

In alternative embodiments, the utensil tray 110 and/or the debris collector tray 120 include different configurations/constructions to allow the utensil tray 110 to nest in the debris collector tray 120, prevent relative movement of the utensil tray 110 relative to the debris collector tray 120, and allow the utensil tray 110 to be easily handled and added/removed relative to the debris collector tray 120. For example, in an alternative embodiment, in locations such as where the debris collector tray 120 includes half-cylindrical members 158, the side walls 162 may have slots (i.e., no material) so that the user can get a hold of the peripheral lip 150 of the utensil tray 110 in these areas for handling the utensil tray 110.

A method of using the suspension system 100 will now be described. The utensil tray 110 is lowered onto and nested into the debris collector tray 120. When nested, the peripheral lip 150 of the utensil tray 110 rests on peripheral ledge 140 of the debris collector tray 120 and the pair of receiving holes 156 of the recessed hole-receiving portions 152 receive the alignment posts/nubs 166 of the half-cylindrical members 158. Utensils are inserted into the plurality of utensil compartments 125, 127 of the utensil tray 110. Debris that is accidentally dropped into the utensil tray 110 falls through the holes 130 of the mesh material 115 of the utensil compartments 125, 127 into the debris collector tray 120.

A utensil drawer may be opened and the suspension system 100 filled with utensils may be inserted into a utensil drawer; the suspension system 100 may be inserted into a utensil drawer and then filled with utensils; the debris collector tray 120 may be inserted into a utensil drawer and then the utensil tray 110, which is already filled with utensils, may be nested into the debris collector tray 120; and/or the debris collector tray 120 may be inserted into a utensil drawer, then the utensil tray 110 may be nested into the debris collector tray 120, and then, finally, the utensils may be inserted into the utensil tray 110 of the suspension system 100.

To clean the suspension system 100, the utensil tray 110 is removed upwardly from the debris collector tray 120. Alignment posts/nubs 166 serve as leverage points to push the debris collector tray 120 away from the utensil tray 110 with one's respective thumbs while lifting the utensil tray 140 away from/out of the debris collector tray 120 at peripheral ledge 140 using one's respective sets of fingers. The debris in the debris collector tray 120 is disposed of (e.g., debris collector tray 120 is removed from utensil drawer and debris collected in the debris collector tray 120 is dumped into a trash can). The debris collector tray 120 and the utensil tray 110 are cleaned (e.g., hand washed, dishwasher washed).

Once cleaned, the utensil drawer is opened, the debris collector tray 120, the utensil tray 110, and utensils are inserted into the utensil drawer, and the utensil drawer is closed.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A suspended utensil storage system, comprising:

a utensil tray including a plurality of utensil compartments having solid side walls and mesh bottom surfaces having a mesh material therein, the plurality of utensil compartments including longitudinally adjacent utensil compartments with spaces therebetween;

a debris collector tray underlying the utensil tray and receiving the utensil tray, the debris collector tray including opposite side walls with laterally inwardly extending supports aligned with and extending within the spaces between longitudinally adjacent utensil compartments;

wherein the mesh material of the utensil compartments of the utensil tray supports utensils and includes holes sized to allow debris to fall there through into the debris collector tray for collecting the debris, and the debris collector tray including a ledge and the utensil tray includes a lip that is supported in the debris collector tray on the ledge.

2. The suspended utensil storage system of claim 1, wherein the utensil tray nests substantially completely within the debris collector tray.

3. The suspended utensil storage system of claim 1, wherein the utensil compartments include a bottom surface and the debris collector tray includes a floor, and the distance between the bottom surface of the utensil compartments and the floor is at least 0.05 in.

4. The suspended utensil storage system of claim 1, wherein the holes sized to allow debris to fall there through include an area of at least 0.0025 in.$^2$ and an area no more than 1.0 in.$^2$

5. A method of using the suspended utensil storage system of claim 1, comprising:

nesting the utensil tray of the suspended utensil storage system into the debris collector tray, the utensil tray including a plurality of longitudinally oriented utensil compartments that receive longitudinally oriented utensils;

inserting utensils longitudinally oriented into the plurality of longitudinally oriented utensil compartments of the utensil tray;

dropping debris into the utensil tray whereby the debris falls through the holes of the mesh material of the utensil compartments into the debris collector tray.

6. The method of using the suspended utensil storage system of claim 5, further including inserting at least one of the debris collector tray and the suspended utensil storage system into a utensil drawer.

7. The method of using the suspended utensil storage system of claim 5, further including removing the utensil tray from the debris collector tray;

disposing of the debris in the debris collector tray.

8. The method of using the suspended utensil storage system of claim 7, further including cleaning the debris collector tray.

9. The method of using the suspended utensil storage system of claim 7, further including cleaning the utensil tray.

10. A method of using the suspended utensil storage system of claim 1, comprising:

nesting the utensil tray of the suspended utensil storage system into the debris collector tray whereby the receiving holes of the utensil tray receive the alignment posts of the debris collector tray;

inserting utensils into the plurality of utensil compartments of the utensil tray;

dropping debris into the utensil tray whereby the debris falls through the holes of the mesh material of the utensil compartments into the debris collector tray.

11. The method of using the suspended utensil storage system of claim 10, further including removing the utensil tray from the debris collector tray by using the alignment posts as leverage points to push the debris collector tray away from the utensil tray with one's respective thumbs while lifting the utensil tray away from the debris collector tray;

disposing of the debris in the debris collector tray.

12. The suspended utensil storage system of claim 1, wherein the suspended utensil storage system is a two-piece storage system.

13. The suspended utensil storage system of claim 1, wherein the utensil tray includes a plurality of longitudinally oriented utensil compartments that receive longitudinally oriented utensils.

14. The suspended utensil storage system of claim 1, wherein the mesh material is a supportive mesh material with the holes therein, the mesh material and the holes including dimensions to support the weight of utensils in the utensil tray so that the mesh material does not bend while allowing debris to pass through the holes.

15. A method of using a suspended utensil storage system including a utensil tray having a plurality of utensil compartments having solid side walls and mesh bottom surfaces having a mesh material therein, the plurality of utensil compartments including longitudinally adjacent utensil compartments with spaces therebetween; a debris collector tray underlying the utensil tray and receiving the utensil tray, the debris collector tray including opposite side walls with laterally inwardly extending supports aligned with and extending within the spaces between longitudinally adjacent utensil compartments; the mesh material of the utensil compartments of the utensil tray supporting utensils and includes holes sized to allow debris to fall there through into the debris collector tray for collecting the debris, the method comprising:

nesting the utensil tray of the suspended utensil storage system into the debris collector tray whereby the laterally inwardly extending supports are aligned with and extending within the spaces between longitudinally adjacent utensil compartments;

inserting utensils into the plurality of utensil compartments of the utensil tray;

dropping debris into the utensil tray whereby the debris falls through the holes of the mesh material of the utensil compartments into the debris collector tray;

removing the utensil tray from the debris collector tray by lifting the utensil tray away from the debris collector tray;

disposing of the debris in the debris collector tray.

16. A suspended utensil storage system, comprising:

a utensil tray including a plurality of utensil compartments having solid side walls and mesh bottom surfaces having a mesh material therein;

a debris collector tray underlying the utensil tray and receiving the utensil tray, the debris collector tray including opposite side walls with laterally inwardly extending supports;

wherein the mesh material of the utensil compartments of the utensil tray supports utensils and includes holes sized to allow debris to fall there through into the debris collector tray for collecting the debris, wherein the utensil tray nests substantially completely within the debris collector tray, the utensil compartments include a bottom surface and the debris collector tray includes a floor, the bottom surface spaced above the floor, the debris collector tray includes a ledge and the utensil tray includes a lip that is supported in the debris collector tray on the ledge, and the plurality of utensil compartments include a plurality of longitudinally extending, horizontally disposed utensil compartments for disposing utensils in a longitudinally extending, horizontal manner.

17. The suspended utensil storage system of claim 16, wherein the utensil compartments include solid side walls and mesh bottom surfaces.

18. The suspended utensil storage system of claim 16, wherein the utensil compartments include solid side walls.

19. The suspended utensil storage system of claim 16, wherein the utensil tray includes a supportive mesh material with holes therein, the mesh material and the holes including dimensions to support the weight of utensils in the utensil tray so that the mesh material does not bend while allowing debris to pass through the holes, and the holes sized to allow debris to fall there through include an area of at least 0.0025 in.$^2$ and an area no more than 1.0 in.$^2$

20. A method of using a suspended utensil storage system, the suspended utensil storage system including a debris collector tray with a floor and a ledge, and a utensil tray with a lip and a plurality of longitudinally oriented utensil compartments that receive longitudinally oriented utensils, the utensil compartments including solid side walls and mesh bottom surfaces with holes therein, comprising:

nesting the utensil tray into the debris collector tray so that the lip of the utensil tray is supported by the ledge of the debris collector tray and the bottom surfaces of the utensil tray is spaced above the floor of the debris collector tray;

inserting utensils longitudinally oriented into the plurality of longitudinally oriented utensil compartments of the utensil tray;

inserting at least one of the debris collector tray and the suspended utensil storage system into a utensil drawer;

dropping debris into the utensil tray whereby the debris falls through the holes of the mesh bottom surfaces of the utensil compartments onto the floor of the debris collector tray spaced below the bottom surfaces of the utensil tray;

removing the utensil tray from the debris collector tray;

disposing of the debris in the debris collector tray.

* * * * *